United States Patent [19]

Bronner

[11] 4,329,392

[45] May 11, 1982

[54] MATTING FOR HYDRAULIC ENGINEERING END-USES

[75] Inventor: Juergen Bronner, Wuppertal, Fed. Rep. of Germany

[73] Assignee: Akzona Incorporated, Asheville, N.C.

[21] Appl. No.: 160,326

[22] Filed: Jun. 17, 1980

[30] Foreign Application Priority Data

Jun. 18, 1979 [DE] Fed. Rep. of Germany ... 7917390[U]

[51] Int. Cl.[3] ..... B01D 39/00; E02B 3/14

[52] U.S. Cl. ..... 428/296; 405/16; 405/19; 428/300; 428/303

[58] Field of Search ..... 405/15, 16, 19, 32; 428/234, 247, 252, 296, 300, 303, 305

[56] References Cited

U.S. PATENT DOCUMENTS 3,811,287 5/1974 Winter ..... 61/38
3,928,696 12/1975 Wandel et al. ..... 428/102
4,168,335 9/1979 Vos et al. ..... 428/58

FOREIGN PATENT DOCUMENTS 2035469 1/1972 Fed. Rep. of Germany ..... 405/19
2408518 9/1975 Fed. Rep. of Germany ..... 405/16

OTHER PUBLICATIONS

"Neue Landschaft", 3/77, p. 116.
Brochure 7393/7/10 of Oltmanns Ziegel and Kunstoffe Co., 2905 Edewecht/Jeddeloh I.

*Primary Examiner*—John E. Kittle
*Attorney, Agent, or Firm*—Francis W. Young; Jack H. Hall

[57] ABSTRACT

Matting for hydraulic engineering consisting of a gripper layer of melt-spun filaments fused with each other and having a diameter of 0.2 to 1.5 mm and a filter layer of fine fibers, where a layer of grain rearrangement inhibiting material runs through the hollow spaces of the gripper layer.

6 Claims, 1 Drawing Figure

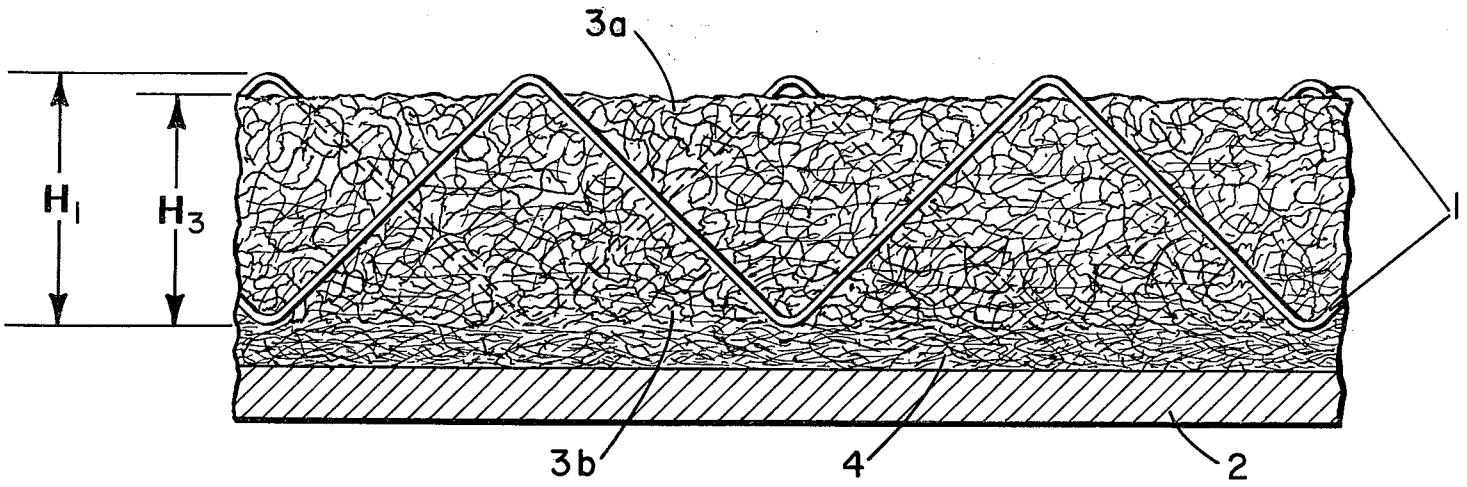
1
2
4
3a
3b
H3
H1

MATTING FOR HYDRAULIC ENGINEERING END-USES

The invention relates to matting for hydraulic engineering end-uses consisting both of a 5 to 70 mm thick gripper layer of a plurality of melt-spun synthetic polymer filaments of a diameter of 0.2 to 1.5 mm intersecting at certain points and fused together at said points and a 1 to 10 mm thick filter layer of fine staple fibers or filaments (referred to herein collectively as fibers) having a filament denier of less than about 15 dtex.

BACKGROUND OF THE INVENTION

Such matting has in the past been used as soil erosion protection, especially below water level, for river shipping lanes and canals. The gripper layer reaches through the fine particles deposited on said soil and forms an interlocking bond with the substructure. The gripping layer of this known matting, which is described in e.g. "Neue Landschaft" 3/77, p. 116 right-hand side, penultimate paragraph, or in the borchure 7393/7/10 of Oltmanns Ziegel and Kunstoffe Co. 2905 Edewecht/Jeddeloh I, is fused at certain points to the filter layer, which may in turn consist of a number of fiber webs and/or woven fabric layers interlocked by needle-punching.

Although literature claims that the use of such matting prevents particle rearrangement under the filter matting, practice indicates that especially in the presence of fine soil particles (class 4) rearrangement or displacement of the particles cannot be entirely avoided, i.e. the filter cake is subjected to washing of the finest particles due to erosion.

An object of the invention is to prevent grain rearrangement and thus against washing of the filter cake. Another object is to increase the peel strength of the matting, i.e., the resistance to separation of the gripper layer from the filter layer.

DESCRIPTION OF THE INVENTION

The objects are met with a mattng of the above-mentioned type in that according to the innovation a grain rearrangement-inhibiting layer of very fine fibers or filaments of preferably an individual denier lower than the individual denier of the fibers or filaments of the filter layer, which rearrangement-inhibiting layer runs through the voids of the gripper layer, thereby being interspersed therein and coincident with said gripper layer. Preferably, the individual denier of the fibers or filaments of the rearrangement-inhibiting layer is less than 10 dtex. The grain rearrangement-inhibiting layer is preferably composed of staple fibers of less than 100 mm in length. The porosity of the grain-rearrangement-inhibiting layer is another preferred version of the innovation varies throughout the layer and decreases in the direction of the filter layer. In a preferred embodiment, there is a prefilter layer of the same material as the grain-rearrangement-inhibiting layer, but of a lower porosity than the latter, between the gripper layer and the filter layer.

Due to the presence of the grain-rearrangement-inhibiting fiber layer in the voids of the gripper layer, the formation of a filter cake is aided and erosion in the finest particle range is prevented especially in the area of the gripper layer and not just at the surface of the filter or prefilter layer as is the case in prior art. The grain-rearrangement-inhibiting layer should run through at least 50% of the gripper layer. Preferably in excess of 90% of the thickness of the gripper layer should be penetrated by the grain-rearrangement-inhibiting layer.

The matting of the invention can be obtained e.g. by compression and thermal bonding of a macrofilament matting forming the gripper layer to a fiber or filament web constituting the filter layer and the adjacent grain-rearrangement-inhibiting layer, by which the fibers forming the grain-rearrangement-inhibiting layer are incorporated in the gripper layer and in the prefilter layer. It is preferable, however, to have the filter layer and, under certain conditions, the prefilter layer interlocked with the gripper layer by needle-punching, whereby needle-punching on the filter side causes the filaments or fibers of the prefilter layer or of the filter layer to penetrate and stay in the voids of the gripper layer. Where the needle stroke corresponds to the thickness of the laminate, i.e. of the finished matting, it is possible to have the grain-rearrangement-inhibiting layer run practically through the entire gripper layer. This preferred version provides simultaneously a laminar/areal bond between the gripper layer and the filter or prefilter layer (if one is present), which compared to the known punctiform fusing of the initial matting sheets (at intervals of about 7 to 8 cm) brings about an increased peel strength, or resistance to delamination.

In this preferred version of the matting of the innovation, the cohesion of the starting matting sheets is achieved without thermal treatment simply by mechanical interlocing of the fibers with each adjacent sheet structure. This makes it possible to manufacture gripper layers on the one hand and filter or prefilter layers on the other hand from different materials that cannot be thermally bonded.

The invention is illustrated in the FIGURE, which shows a cross section of a preferred version comprising a gripper layer 1 of a thickness $H_1$, a filter layer and a prefilter layer 4. A grain-rearrangement-inhibiting layer 3*a*,3*b* of a thickness $H_3$ runs through gripper layer 1, $H_3$ preferably being as close as possible to $H_1$. The porosity of portion 3*a* of the grain-rearrangement-inhibiting layer is preferably greater than that of portion 3*b*, the transition may be gradual, and in progressing toward filter layer 2 the porosity approaches that of prefilter layer 4.

I claim:

1. A laminate hydraulic engineering matting capable of inhibiting rearrangement of soil particles within said matting comprising a gripper layer of 5–70 mm thickness comprising a plurality of intersecting melt-spun synthetic polymer filaments of a diameter of 0.2 to 1.5 mm and fused at said points of intersection, a filter layer of fine fibers having a thickness of from about 1 to about 10 mm thick, said fine fibers having a denier of less than about 15 dtex, and a third layer comprising fibers interspersed throughout at least 50% of said gripper layer and coincident therewith having individual filament deniers lower than the denier of the fibers of said filter layer.

2. The matting of claim 1, wherein the denier of the fibers or filaments of said particle rearrangement-inhibiting third layer is less than 10 dtex.

3. The matting of claim 2, wherein said grain rearrangement-inhibiting layer is composed of staple fibers less than 100 mm in length.

4. The matting of claim 1, wherein the porosity of the grain rearrangement-inhibiting layer is variable and decreases in the direction of said filter layer.

5. The matting of claim 1, wherein a prefilter layer of the same material as the rearrangement-inhibiting layer is dispersed between said gripper layer and said filter layer, said prefilter layer having a lower porosity than said rearrangement-inhibiting layer and said rearrangement-inhibiting layer is interspersed within the coincident with said prefilter layer.

6. The matting of claim 5, wherein said filter layer, said prefilter layer and said gripper layer are needlepunched together to form an integral laminate having increased peel strength.

* * * * *